US010676168B1

(12) United States Patent
Wentworth et al.

(10) Patent No.: US 10,676,168 B1
(45) Date of Patent: Jun. 9, 2020

(54) BREATHING-AIR TANK PRESSURE TRACKING SYSTEM

(71) Applicant: United States of America as represented by the Secretary of the Navy, Arlington, VA (US)

(72) Inventors: Brian C. Wentworth, Panama City, FL (US); Dennis Gallagher, Panama City, FL (US); Richard Manley, Panama City, FL (US); William Hughes, III, Panama City, FL (US); Bryan Le, Panama City Beach, FL (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/399,311

(22) Filed: Apr. 30, 2019

(51) Int. Cl.
*G08B 21/00* (2006.01)
*B63C 11/12* (2006.01)
*F17C 13/02* (2006.01)

(52) U.S. Cl.
CPC ..... *B63C 11/12* (2013.01); *F17C 13/025* (2013.01); *B63C 2011/121* (2013.01); *F17C 2270/0781* (2013.01)

(58) Field of Classification Search
CPC ..... B63C 11/12; B63C 11/02; G08B 3/00; G08B 5/00
USPC ..... 340/626
See application file for complete search history.

(56) References Cited

U.S. PATENT DOCUMENTS 6,360,182 B1 * 3/2002 Hales ..... A62B 18/08 702/139
6,837,240 B1 * 1/2005 Olstad ..... B63C 11/02 128/201.27
7,089,930 B2 * 8/2006 Adams ..... A62B 9/006 128/201.27
7,477,207 B2 * 1/2009 Estep ..... B63C 11/26 345/8
9,851,752 B2 * 12/2017 Holopainen ..... G06F 1/163

* cited by examiner

*Primary Examiner* — Toan N Pham
(74) *Attorney, Agent, or Firm* — James T. Shepherd

(57) ABSTRACT

A breathing-air tank pressure tracking system includes a housing having lights mounted therein. The lights are spaced-apart from one another and disposed along a line. A pressure sensor is coupled to a tank containing pressurized breathing air. The pressure sensor detects a pressure of the pressurized breathing air and produces a signal indicative thereof. The housing is configured to be coupled to an exterior portion of a dive helmet wherein the lights are positioned in a field-of-view of a user wearing the dive helmet. A controller, mounted in the housing, is coupled to the pressure sensor and the lights. The controller activates selected ones of the lights based on the signal received from the pressure sensor.

11 Claims, 2 Drawing Sheets

BREATHING-AIR TANK PRESSURE TRACKING SYSTEM

ORIGIN OF THE INVENTION

The invention described herein may be manufactured and used by or for the Government of the United States of America for Governmental purposes without payment of any royalties.

FIELD OF THE INVENTION

The invention relates generally to breathing-air tank gauges, and more particularly to a system for tracking a breathing-air tank's pressure that is always viewable and readily discernible by a user of the tank.

BACKGROUND OF THE INVENTION

Underwater divers and firefighters rely on breathing air supplied by self-carried tanks of pressurized breathing air. The pressure of the breathing air in a tank is indicative of the amount of breathing air remaining in the tank. Analog gauges are typically provided on a tank, but such gauges can be difficult to read/monitor during a dive due to water turbidity, position of the gauge, etc. An additional or alternative approach is the provision of an emergency light that is lit when a tank's pressure reaches a predetermined low level. However, an emergency light does not convey any gauge information. Furthermore, if the emergency light and/or its triggering system experience a failure, the tank's emergency warning capability is lost.

SUMMARY OF THE INVENTION

Accordingly, it is an object of the present invention to provide a pressure tracking system for use with a tank of pressurized breathing air.

Another object of the present invention is to provide a breathing-air tank pressure tracking system that presents quantifiable tank pressure data in the field-of-view of a tank's user.

Other objects and advantages of the present invention will become more obvious hereinafter in the specification and drawings.

In accordance with the present invention, a breathing-air tank pressure tracking system includes a housing and a plurality of lights mounted in the housing. The lights are spaced-apart from one another and disposed along a line. A pressure sensor is coupled to a tank containing pressurized breathing air wherein the pressure sensor detects a pressure of the pressurized breathing air and produces a signal indicative thereof. The housing is configured to be coupled to an exterior portion of a dive helmet wherein the lights are positioned in a field-of-view of a user wearing the dive helmet. A controller, mounted in the housing, is coupled to the pressure sensor and the lights. The controller activates selected ones of the lights based on the signal received from the pressure sensor.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
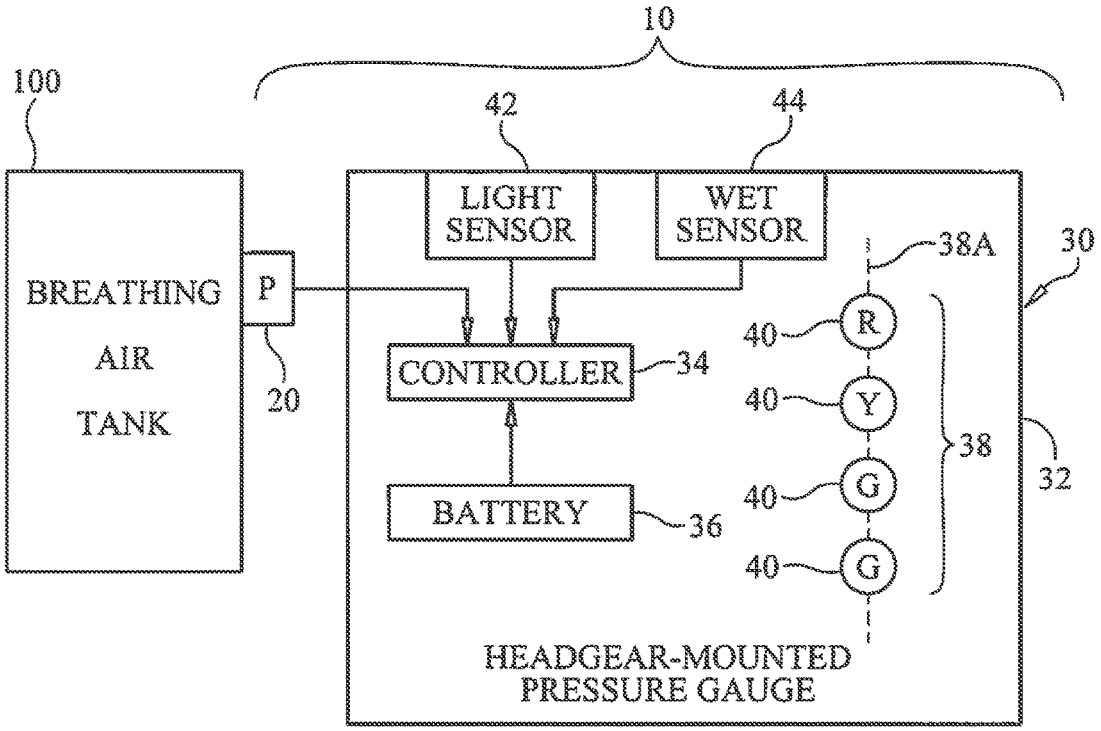
FIG. 1 is a schematic view of a breathing-air tank pressure tracking system in accordance with an embodiment of the present invention.

Referring now to the drawings and more particularly to FIG. 1, a schematic view of a breathing-air tank pressure tracking system in accordance with an embodiment of the present invention is shown and is referenced generally by numeral 10. As will be described further below, tracking system 10 provides quantifiable data indicative of the pressure of breathing air contained within a breathing air tank 100. Such breathing air tanks are well-known and used by underwater divers, firefighters, hazardous material workers, etc. It is to be understood that the type of tank 100 is not a limitation of the present invention.

Tracking system 10 includes a pressure sensor ("P") 20 and a headgear-mounted pressure gauge 30. Pressure sensor 20 is any device (e.g., a pressure transducer) that can be coupled to tank 100 for the purpose of detecting gas pressure within tank 100 and converting the sensed pressure to a signal indicative thereof. Pressure gauge 30 is a device that includes a housing 32 mountable on the headgear (not shown) of a user of tank 100. Such users include underwater divers, firefighters, hazardous material workers, etc. Accordingly, the headgear will typically include a head covering, a see-through face plate supported in/by the head covering, and coupling mechanisms for respiration gear that will receive the breathing air from tank 100. In general, housing 32 is configured to be mounted on the headgear such that a user can readily view the gauge information provided by pressure gauge 30. By way of an illustrative and non-limiting example, the present invention will be explained for its use with an underwater dive helmet such as the Divator MKII FFM available from Interspiro AS Täby, Sweden.

Mounted in housing 32 are a number of operational components of pressure gauge 30. At a minimum, pressure gauge 30 includes a controller 34, a power source such as a battery 36 (e.g., replaceable, rechargeable, etc.) and an array 38 of lights 40 (e.g., light emitting diodes or LEDs). Controller 34 is any programmable microcontroller that controls the signal processing operation of pressure gauge 30 as will be described further below. Battery 36 provides the needed electric power for controller 34 and lights 40. In general, controller 34 receives a pressure signal from pressure sensor 20 and, based on the pressure signal, activates selected ones of lights 40 to provide a visual indication of the pressure in tank 100.

Array 38 of lights 40 is a linear array with lights 40 being arranged in a spaced-apart fashion along a straight line 38A. In the illustrated embodiment, four lights 40 are arranged along line 38A with two of lights 40 presenting a green ("G") color when activated, one of lights 40 presenting a yellow ("Y") color when activated, and one of lights 40 presenting a red ("R") color when activated. The two green lights 40 are adjacent to one another and the yellow light 40 is disposed between one of green lights 40 and the red light 40.

In general, controller 34 controls activation of lights 40 in a way that presents the user with simple pressure quantity data indicative of the remaining pressure in tank 100. For example, controller 34 can activate a selected grouping of lights 40 with each such grouping being associated with a range of pressure levels. By way of an illustrative example, the table below presents a light grouping activation scheme useful for presenting pressure range data for underwater dive tanks of breathing air. As is known in the art, there are two basic types of breathing air tanks used for underwater diving, i.e., one whose maximum pressure is 4000 pounds per square inch (PSI) and one whose maximum pressure is 3300 PSI. For this reason, the illustrative example makes use of two green lights 40. The table below lists the number of lights 40 that are activated for different pressure ranges as well as the corresponding grouping.

| PRESSURE (PSI) | ACTIVATED LIGHTS | ACTIVATED COLORS |
|---|---|---|
| ≥4000 | 4 | GGYR |
| 3000-4000 | 3 | GYR |
| 2000-3000 | 2 | YR |
| 1000-2000 | 1 | R |
| 500-1000 | 1 (blinking) | R |
| 0-500 | 1 (rapid blinking) | R |

The use of two green lights 40 allows pressure gauge 30 to be used with both types of breathing air tanks since either type of tank, when full, will present the user with at least one green light. The number of lights being activated is reduced in correspondence with pressure reductions within tank 100. Since only four lights 40 are used, a user can readily discern the number of lights that are activated. Further, by using a generalized "traffic light" color scheme, the sequential reduction to just red light 40 can be readily perceived as low tank pressure. Still further, controlling activation of the single red light 40 (i.e., from steady on to rapid blinking) can still be used to provide pressure quantity data.

Pressure gauge 30 can include additional features. For example, a light sensor 42 can be provided on housing 32. Light sensor 42 provides a signal indicative of ambient light conditions to controller 34 that, in turn, controls the brightness of lights 40 being activated. In this way, lights 40 can present the user with a light level suitable for viewing in the environmental conditions being experienced by the user. For underwater dive applications, pressure gauge 30 can also include a wet sensor 44 on housing 32. Wet sensor 44 provides a signal to controller 34 indicative of pressure gauge 30 being in a water environment. This information can be used by controller 34 to save power when housing 32 is in a dry environment.

Figure 2:
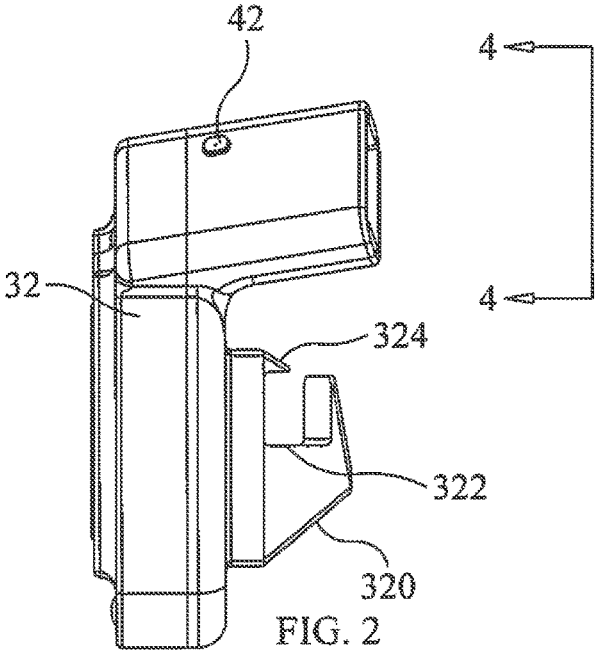
FIG. 2 is a perspective view of the tank pressure tracking system's housing in accordance with an embodiment of the present invention.
Figure 3:
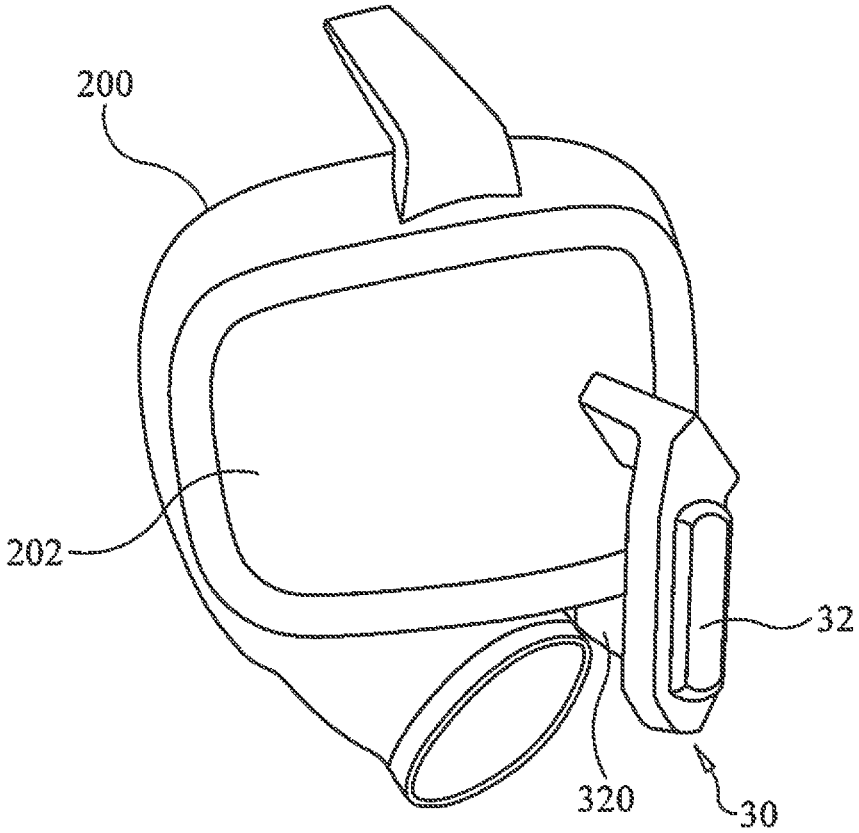
FIG. 3 is a perspective view of the tank pressure tracking system's housing illustrated in FIG. 2 coupled to an underwater dive helmet.

An exemplary embodiment of housing 32 will now be described with reference to FIGS. 2-4. In this illustrated embodiment, housing 32 is a one-piece body that includes a bracket 320 that is used to couple housing 32 to a user's headgear. For example, FIG. 3 illustrates the above-maintained MKII FFM dive helmet 200 with bracket 320 being configured to attach to the underside of the helmet's see-through face plate 202. In this case, bracket 320 includes a U-shaped channel 322 and locking tab 324 to engage with the underside of face plate 202 without the use of any tools. It is to be understood that other bracket configurations could be used without departing from the scope of the present invention.

Figure 4:
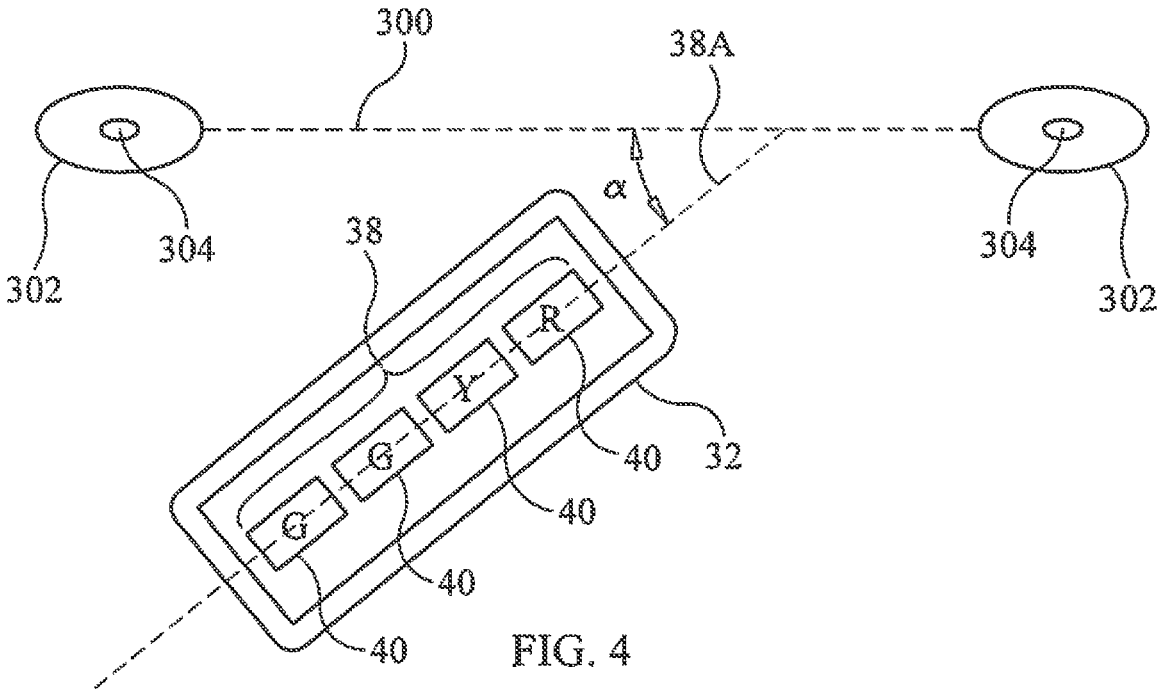
FIG. 4 is a plan view taken along line 4-4 in FIG. 2 illustrating a four-light arrangement disposed in the tank pressure tracking system's housing in accordance with an embodiment of the present invention.

As shown in FIG. 4, housing 32 positions line 38A of array 38 at an angle $\alpha$ of approximately 52° relative to a datum line 300 aligned with the centers 302 of eyes 304 of a user wearing helmet 200. It has been found that this angular relationship provides the vast majority of users with a clear view of array 38 without requiring any adjustment.

The advantages of the present invention are numerous. Users of pressurized breathing air tanks are provided with simple visual cues indicative of the amount of pressure remaining in their breathing air tanks. This critical pressure data is provided continuously in a user's field-of-view thereby eliminating the problem associated with analog gauges mounted on tanks and/or conventional single-light binary emergency warning systems.

Although the invention has been described relative to specific embodiments thereof, there are numerous variations and modifications that will be readily apparent to those skilled in the art in light of the above teachings. For example, the lights used in the array need not be a dedicated-color light as each light could be a multicolor LED configurable to illuminate as a color of choice. Still further, the lights in the array could additionally be used to provide a unique indication of a low-battery condition. It is therefore to be understood that, within the scope of the appended claims, the invention may be practiced other than as specifically described.

What is claimed as new and desired to be secured by Letters Patent of the United States is:

1. A breathing-air tank pressure tracking system, comprising:

a housing;

a plurality of lights mounted in said housing, said lights being spaced-apart from one another and disposed along a line;

a pressure sensor adapted to be coupled to a tank containing pressurized breathing air wherein said pressure sensor detects a pressure of the pressurized breathing air and produces a signal indicative thereof;

said housing including a bracket having a U-shaped channel and locking tab adapted for tool-free coupling to an exterior underside portion of a dive helmet's face plate wherein said lights are adapted to be positioned in a field-of-view of a user wearing the dive helmet, and wherein said line is at an angle of approximately 52° relative to a datum line aligned with the centers of the user's eyes;

a controller mounted in said housing and coupled to said pressure sensor and said lights, wherein said controller activates selected ones of said lights based on said signal; and a wet sensor disposed on said housing and coupled to said controller, said wet sensor generating an activation signal when said wet sensor is wet wherein said controller controls power to said lights based on said activation signal.

2. A tank pressure tracking system as in claim 1, further comprising a light sensor mounted on said housing and coupled to said controller, said light sensor generating an ambient light signal indicative of ambient light intensity wherein said controller adjusts intensity of said lights based on said ambient light signal.

3. A tank pressure tracking system as in claim 1, wherein said plurality of lights comprises four lights.

4. A tank pressure tracking system as in claim 1, wherein said plurality of lights comprises two green lights, one yellow light, and one red light.

5. A tank pressure tracking system as in claim 1, wherein said plurality of lights comprises two green lights adjacent to one another, a yellow light adjacent to one of said green lights, and a red light adjacent to said yellow light.

6. A tank pressure tracking system as in claim 1, wherein said controller reduces said selected ones of said lights being activated as the pressure of the pressurized breathing air decreases.

7. A breathing-air tank pressure tracking system, comprising:

a housing;

four lights mounted in said housing, said lights being spaced-apart from one another and disposed along a line;

a pressure sensor adapted to be coupled to a tank containing pressurized breathing air wherein said pressure sensor detects a pressure of the pressurized breathing air and produces a signal indicative thereof;

said housing including a bracket having a U-shaped channel and locking tab adapted for tool-free coupling to an exterior underside portion of a dive helmet's face plate, wherein said lights are adapted to be positioned in a field-of-view of a user wearing the dive helmet, and wherein said lights along said line are positioned outside of the helmet's face plate at an angle of approximately 52° relative to a datum line aligned with the centers of the user's eyes;

a controller mounted in said housing and coupled to said pressure sensor and said lights, wherein said controller activates selected ones of said lights based on said signal; and a wet sensor disposed on said housing and coupled to said controller, said wet sensor generating a signal when said wet sensor is wet wherein said controller controls power to said lights based on said signal.

8. A tank pressure tracking system as in claim 7, further comprising a light sensor mounted on said housing and coupled to said controller, said light sensor generating an ambient light signal indicative of ambient light intensity wherein said controller adjusts intensity of said lights based on said ambient light signal.

9. A tank pressure tracking, system as in claim 7, wherein said four lights comprise two green lights, one yellow light, and one red light.

10. A tank pressure tracking system as in claim 7, wherein said four lights comprise two green lights adjacent to one another, a yellow light adjacent to one of said green lights, and a red light adjacent to said yellow light.

11. A tank pressure tracking system as in claim 7, wherein said controller reduces said selected ones of said lights being activated as the pressure of the pressurized breathing air decreases.

* * * * *